US006662874B2

(12) United States Patent
Surjaatmadja et al.

(10) Patent No.: US 6,662,874 B2
(45) Date of Patent: Dec. 16, 2003

(54) SYSTEM AND METHOD FOR FRACTURING A SUBTERRANEAN WELL FORMATION FOR IMPROVING HYDROCARBON PRODUCTION

(75) Inventors: Jim B. Surjaatmadja, Duncan, OK (US); Alick Cheng, Calgary (CA); Keith A. Rispler, Red Deer (CA)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 09/966,128

(22) Filed: Sep. 28, 2001

(65) Prior Publication Data

US 2003/0062167 A1 Apr. 3, 2003

(51) Int. Cl.[7] ..... E21B 43/25
(52) U.S. Cl. ..... 166/308; 166/309; 175/67
(58) Field of Search ..... 166/298, 308, 166/309, 310, 280; 175/67, 69, 71, 339, 340

(56) References Cited

U.S. PATENT DOCUMENTS

| | | | | |
|---|---|---|---|---|
| 2,802,537 A | | 8/1957 | Goldinger | 166/224 |
| 4,044,833 A | | 8/1977 | Volz | 166/307 |
| 4,453,596 A | | 6/1984 | Conway et al. | 166/278 |
| 4,453,597 A | | 6/1984 | Brown et al. | 166/303 |
| 4,615,564 A | * | 10/1986 | Garrett | 199/7 |
| 4,730,676 A | | 3/1988 | Luers et al. | 166/309 |
| 5,060,725 A | * | 10/1991 | Buell | 166/222 |
| 5,361,856 A | | 11/1994 | Surjaatmadja et al. | 175/67 |
| 5,494,103 A | | 2/1996 | Surjaatmadja et al. | 166/222 |
| 5,499,678 A | | 3/1996 | Surjaatmadja et al. | 166/298 |
| 5,765,642 A | | 6/1998 | Surjaatmadja et al. | 166/297 |
| 6,325,305 B1 | * | 12/2001 | Kuhlman et al. | 239/548 |
| 6,394,184 B2 | * | 5/2002 | Tolman et al. | 166/281 |

FOREIGN PATENT DOCUMENTS

| | | | |
|---|---|---|---|
| EP | 0229434 | 12/1986 | E21B/43/243 |
| EP | 0851094 | 12/1997 | E21B/43/26 |
| WO | WO 02/23010 | 3/2002 | E21B/43/26 |

OTHER PUBLICATIONS

"Hydrajet Fracturing: An Effective Method for Placing Many Fractures in Openhole Horizontal Wells" (SPE 48856) by J. B. Surjaatmaja, et al.

* cited by examiner

*Primary Examiner*—Frank Tsay
(74) *Attorney, Agent, or Firm*—Robert A. Kent; Warren B. Kice

(57) ABSTRACT

A method of fracturing a downhole formation according to which a plurality of jet nozzles are located in a spaced relation to the wall of the formation to form an annulus between the nozzles and the formation. A non-acid containing stimulation fluid is pumped at a predetermined pressure through the nozzles, into the annulus, and against the wall of the formation, and a gas is introduced into the annulus so that the stimulation fluid mixes with the gas to generate foam before the mixture is jetted towards the formation to form fractures in the formation.

20 Claims, 2 Drawing Sheets

SYSTEM AND METHOD FOR FRACTURING A SUBTERRANEAN WELL FORMATION FOR IMPROVING HYDROCARBON PRODUCTION

BACKGROUND

This disclosure relates to a system and method for treating a subterranean well formation to stimulate the production of hydrocarbons and, more particularly, such an apparatus and method for fracturing the well formation.

Several techniques have evolved for treating a subterranean well formation to stimulate hydrocarbon production. For example, hydraulic fracturing methods have often been used according to which a portion of a formation to be stimulated is isolated using conventional packers, or the like, and a stimulation fluid containing gels, acids, sand slurry, and the like, is pumped through the well bore into the isolated portion of the formation. The pressurized stimulation fluid pushes against the formation at a very high force to establish and extend cracks on the formation. However, the requirement for isolating the formation with packers is time consuming and considerably adds to the cost of the system.

One of the problems often encountered in hydraulic fracturing is fluid loss which for the purposes of this application is defined as the loss of the stimulation fluid into the porous formation or into the natural fractures existing in the formation.

Fluid loss can be reduced using many ways, such as by using foams. Since foams are good for leak off prevention, they also help in creating large fractures. Conventionally, foaming equipment is provided on the ground surface that creates a foam, which is then pumped downhole. Foams, however, have much larger friction coefficients and reduced hydrostatic effects, both of which severely increase the required pressures to treat the well.

Therefore, what is needed is a stimulation treatment according to which the need for isolation packers is eliminated, the foam generation is performed in-situ downhole, and the fracture length is improved.

SUMMARY

According to an embodiment of the present invention, the techniques of fracturing, isolation and foam generation are combined to produce an improved stimulation of the formation. To this end, a stimulation fluid is discharged through a workstring and into a wellbore at a relatively high impact pressure and velocity without the need for isolation packers to fracture the formation.

DETAILED DESCRIPTION

Figure 1:
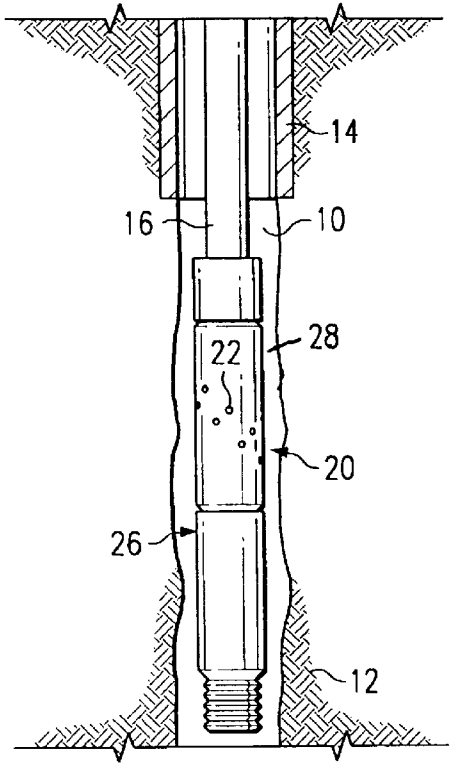
FIG. 1 is a sectional view of a fracturing system according to an embodiment of the present invention, shown in a vertical wellbore.

Referring to FIG. 1, a stimulation system according to an embodiment of the present invention is shown installed in an underground, substantially vertically-extending, wellbore 10 that penetrates a hydrocarbon producing subterranean formation 12. A casing 14 extends from the ground surface (not shown) into the wellbore 10 and terminates above the formation. The stimulation system includes a work string 16, in the form of piping or coiled tubing, that also extends from the ground surface and through the casing 14. The work string 16 extends beyond, or below, the end of the casing 14 as viewed in FIG. 1, and one end of the work string 16 is connected to one end of a tubular jet sub 20 in a manner to be described. The jet sub 20 has a plurality of through openings 22 machined through its wall that form discharge jets which will be described in detail later.

A valve sub 26 is connected to the other end of the jet sub 20, also in a manner to be described. The end of the work string 16 at the ground surface is adapted to receive a stimulation fluid, to be described in detail, and the valve sub 26 is normally closed to cause flow of the stimulation fluid to discharge from the jet sub 22. The valve sub 26 is optional and is generally required for allowing emergency reverse circulation processes, such as during screenouts, equipment failures, etc. An annulus 28 is formed between the inner surface of the wellbore 10 and the outer surfaces of the workstring 16 and the subs 20 and 26.

The stimulation fluid is a non-acid fluid, which, for the purposes of this application is a fluid having a pH level above 5. The fluid can contains a viscosifier such as water base or oil base gels, in addition to the necessary foaming agents, along with various additives, such as surfactants, foam stabilizers, and gel breakers, that are well known in the art. Typical fluids include linear or crosslinked gels, oil base or water base; where the gelling agent can be polysaccharide such as guar gum, HPG, CMHPG, CMG; or cellulose derivatives such as CMHEC and HEC. Crosslinkers can be borate, Ti, Zr, Al, Antimony ion sources or mixtures. A more specific, but non-limiting, example of the type of fluid is a 40 pound per thousand gallon of HEC, containing surfactants, and breakers. This mixture will hereinafter be referred to as "stimulation fluid." This stimulation fluid can be mixed with gas and/or sand or artificial proppants when needed, as will be described.

The respective axes of the jet sub 20 and the valve sub 26 extend substantially vertically in the wellbore 10. When the stimulation fluid is pumped through the work string 16, it enters the interior of the jet sub 20 and discharges through the openings 22, into the wellbore 10, and against the formation 12.

Figure 2:
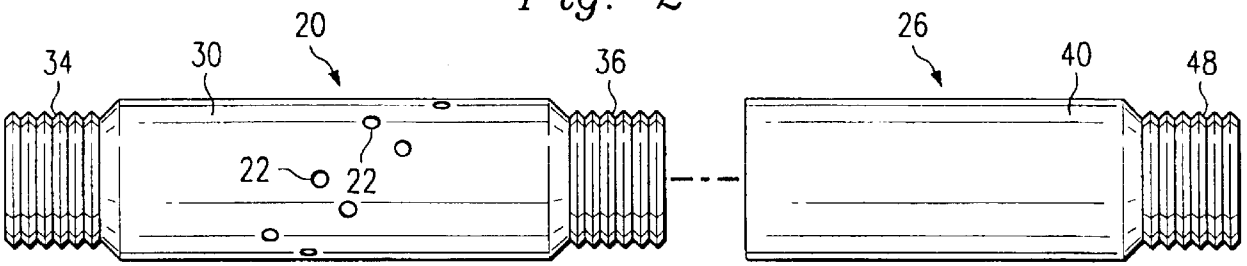
FIG. 2 is an exploded elevational view of two components of the systems of FIGS. 1 and 2.
Figure 3:
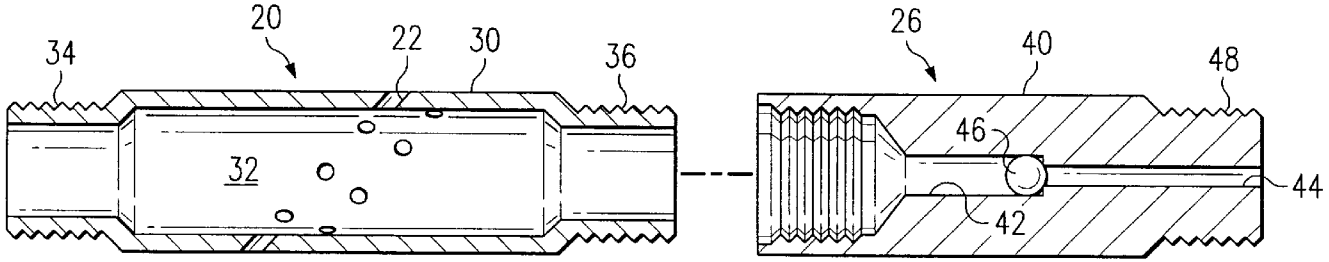
FIG. 3 is a cross-sectional view of the components of FIG. 2.

Details of the jet sub 20 and the ball valve sub 26 are shown in FIGS. 2 and 3. The jet sub 20 is formed by a tubular housing 30 that includes a longitudinal flow passage 32 extending through the length of the housing. The openings 22 extend through the wall of the casing in one plane and can extend perpendicular to the axis of the casing as shown in FIG. 2, and/or at an acute angle to the axis of the casing as shown in FIG. 3, and/or aligned with the axis (not shown). Thus, the stimulation fluid from the work string 16 enters the housing 30, passes through the passage 32 and is discharged from the openings 22. The stimulation fluid discharge pattern is in the form of a disc extending around the housing 30.

As a result of the high pressure stimulation fluid from the interior of the housing 30 being forced out the relatively small openings 22, a jetting effect is achieved. This is caused by the stimulation fluid being discharged at a relatively high differential pressure, such as 3000–6000 psi, which accelerates the stimulation fluid to a relatively high velocity, such as 650 ft./sec. This high velocity stimulation fluid jetting into the wellbore 10 causes drastic reduction of the pressure surrounding the stimulation fluid stream (based upon the well known Bernoulli principle), which eliminates the need for the isolation packers discussed above.

Two tubular nipples 34 and 36 are formed at the respective ends of the housing 30 and preferably are formed integrally with the housing. The nipples 34 and 36 have a smaller diameter than that of the housing 30 and are externally threaded, and the corresponding end portion of the work string 16 (FIG. 1) is internally threaded to secure the work string to the housing 30 via the nipple 34.

The valve sub 26 is formed by a tubular housing 40 that includes a first longitudinal flow passage 42 extending from one end of the housing and a second longitudinal flow passage 44 extending from the passage 42 to the other end of the housing. The diameter of the passage 42 is greater than that of the passage 44 to form a shoulder between the passages, and a ball 46 extends in the passage 42 and normally seats against the shoulder.

An externally threaded nipple 48 extends from one end of the casing 40 for connection to other components (not shown) that may be used in the stimulation process; such as sensors, recorders, centralizers and the like. The other end of the housing 40 is internally threaded to receive the externally threaded nipple 36 of the jet sub 20 to connect the housing 40 of the valve sub 26 to the housing 30 of the jet sub.

It is understood that other conventional components, such as centering devices, BOPs, strippers, tubing valves, anchors, seals etc. can be associated with the system of FIG. 1. Since these components are conventional and do not form any part of the present invention, they have been omitted from FIG. 1 in the interest of clarity.

In operation, the ball 46 is dropped into the work string 16 and the stimulation fluid is mixed with some relatively fine or relatively coarse proppants and is continuously pumped from the ground surface through the work string 16 and the jet sub 20 and to the valve sub 26. In the valve sub 26, the ball 46 passes through the passage 42 and seats on the shoulder between the passages 42 and 44. The fluid pressure thus builds up in the subs 20 and 26, causing proppant-laden stimulation fluid to discharge through the openings 22.

During the above, a gas, consisting essentially of carbon dioxide or nitrogen, is pumped from the ground surface and into the annulus 28 (FIG. 1). The gas flows through the annulus 28 and is mixed with, and carried by, the proppent-laden stimulation fluid from the annulus towards the formation causing a high energy mixing to generate foam. The mixture of the stimulation fluid, proppants, and gas is hereinafter being referred to as a "mixture," which impacts against the wall of the formation.

The pumping rate of the stimulation fluid is then increased to a level whereby the pressure of the fluid jetted through the openings 22 reaches a relatively high differential pressure and high discharge velocity such as those set forth above. This creates cavities, or perforations, in the wellbore wall and helps erode the formation walls.

As each of the cavities becomes sufficiently deep, the confined mixture will pressurize the cavities. Paths for the mixture are created in the bottoms of the above cavities in the formation which serve as output ports into the formation, with the annulus 28 serving as an input port to the system. Thus, a virtual jet pump is created which is connected directly to the formation. Moreover, each cavity becomes a small mixing chamber which significantly improves the homogeneity and quality of the foam. After a short period of time, the cavities becomes substantially large and the formation fractures and the mixture is then either pushed into the fracture or returned into the wellbore area.

At this time, the mixture can be replaced with a pad mixture which consists of the stimulation fluid and the gas, but without any relatively coarse proppants, although it may include a small amount of relatively fine proppants. The primary purpose of the pad mixture is to open the fracture to permit further treatment, described below. If it is desired to create a relatively large fracture, the pressure of the pad mixture in the annulus 28 around the sub 20 is controlled so that it is less than, or equal to, the hydraulic fracturing pressure of the formation. The impact or stagnation pressure will bring the net pressure substantially above the required fracturing pressure; and therefore a substantially large fracture (such as 25 ft to 500 ft or more in length) can be created. In this process, the foam in the pad mixture reduces losses of the pad mixture into the fracture face and/or the natural fractures. Thus, most of the pad mixture volume can be used as a means for extending the fracture to produce a relatively large fracture.

The pad mixture is then replaced with a mixture including the stimulation fluid and the gas which form a foam in the manner discussed above, along with a relatively high concentration of relatively coarse proppants. This latter mixture is introduced into the fracture, and the amount of mixture used in this stage depends upon the desired fracture length and the desired proppant density that is delivered into the fracture.

Once the above is completed, a flush stage is initiated according to which the foamed stimulation fluid and gas, but without any proppants, is pumped into the workstring 16, until the existing proppants in the workstring from the previous stage are pushed out of the workstring. In this context, before all of the proppants have been discharged from the workstring, it may be desired to "pack" the fracture with proppants to increase the proppant density distribution in the fracture and obtain a better connectivity between the formation and the wellbore. To do this, the pressure of the mixture in the annulus 28 is reduced to a level higher than the pressure in the pores in the formation and below the fracturing pressure, while the proppant-laden fluid is continually forced into the fracture and is slowly expended into the fracture faces. The proppants are thus packed into the fracture and bridge the narrow gaps at the tip of the fracture, causing the fracture to stop growing, which is often referred to as a "tip screenout." The presence of the foam in the mixture reduces the fluid loss in the mixture with the formation so that the fracture extension can be substantially increased.

After the above operations, if it is desired to clean out foreign material such as debris, pipe dope, etc. from the wellbore 10, the work string 16, and the subs 20 and 26, the pressure of the stimulation fluid in the work string 16 is reduced and a cleaning fluid, such as water, at a relatively high pressure, is introduced into the annulus 28. After reaching a depth in the wellbore 10 below the subs 20 and 26, this high pressure cleaning fluid flows in an opposite direction to the direction of the stimulation fluid discussed above and enters the discharge end of the flow passage 44 of the valve sub 26. The pressure of the cleaning fluid forces the ball valve 46 out of engagement with the shoulders between the passages 42 and 44 of the sub 26. The ball valve 46 and the cleaning fluid pass through the passage 42, the jet sub 20, and the work string 16 to the ground surface. This circulation of the cleaning fluid cleans out the foreign material inside the work string 16, the subs 20 and 26, and the well bore 10.

After the above-described cleaning operation, if it is desired to initiate the discharge of the stimulation fluid against the formation wall in the manner discussed above, the ball valve 46 is dropped into the work string 16 from the ground surface in the manner described above, and the stimulation fluid is introduced into the work string 14, as discussed above.

Figure 4:
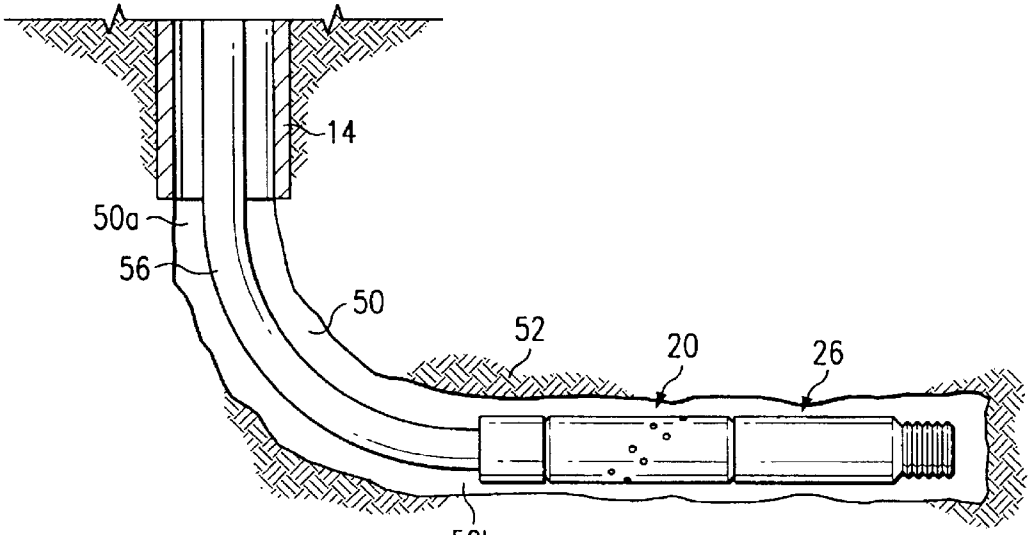
FIG. 4 is a sectional view of a fracturing system according to an embodiment of the present invention, shown in a wellbore having a horizontal deviation.

FIG. 4 depicts a stimulation system, including some of the components of the system of FIGS. 1–3 which are given the same reference numerals. The system of FIG. 4 is installed in an underground wellbore 50 having a substantially vertical section 50*a* extending from the ground surface and a deviated, substantially horizontal section 50*b* that extends from the section 50*a* into a hydrocarbon producing subterranean formation 52. As in the previous embodiment, the casing 14 extends from the ground surface into the wellbore section 50*a*.

The stimulation system of FIG. 4 includes a work string 56, in the form of piping or coiled tubing, that extends from the ground surface, through the casing 14 and the wellbore section 50*a*, and into the wellbore section 50*b*. As in the previous embodiment, stimulation fluid is introduced into the end of the work string 56 at the ground surface (not shown). One end of the tubular jet sub 20 is connected to the other end of the work string 56 in the manner described above for receiving and discharging the stimulation fluid into the wellbore section 50*b* and into the formation 52 in the manner described above. The valve sub 26 is connected to the other end of the jet sub 20 and controls the flow of the stimulation fluid through the jet sub in the manner described above. The respective axes of the jet sub 20 and the valve sub 26 extend substantially horizontally in the wellbore section 50*b* so that when the stimulation fluid is pumped through the work string 56, it enters the interior of the jet sub 20 and is discharged, in a substantially radial or angular direction, through the wellbore section 50*b* and against the formation 52 to fracture it in the manner discussed above. The horizontal or deviated section of the wellbore is completed openhole and the operation of this embodiment is identical to that of FIG. 1. It is understood that, although the wellbore section 50*b* is shown extending substantially horizontally in FIG. 4, the above embodiment is equally applicable to wellbores that extend at an angle to the horizontal.

In connection with formations in which the wellbores extend for relatively long distances, either vertically, horizontally, or angularly, the jet sub 20, the valve sub 26 and workstring 56 can be initially placed at the toe section (i.e., the farthest section from the ground surface) of the well. The fracturing process discussed above can then be repeated numerous times throughout the horizontal wellbore section, such as every 100 to 200 feet.

Figure 5:
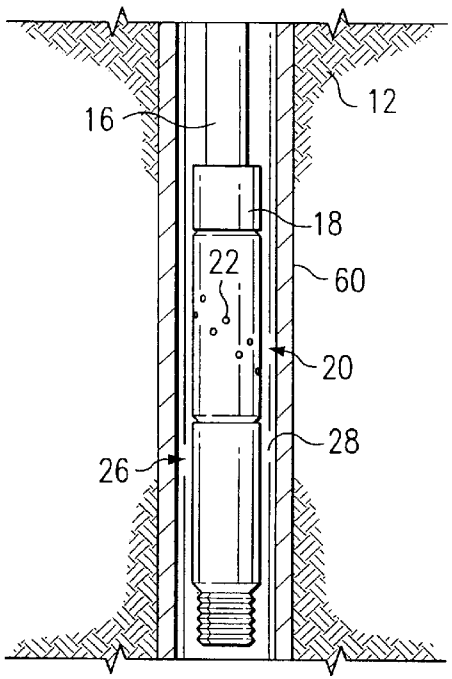
FIG. 5 is a view similar to that of FIG. 1 but depicting an alternate embodiment of the fracturing system of the present invention shown in a vertical wellbore.

The embodiment of FIG. 5 is similar to that of FIG. 1 and utilizes many of the same components of the latter embodiments, which components are given the same reference numerals. In the embodiment of FIG. 5, a casing 60 is provided which extends from the ground surface (not shown) into the wellbore 10 formed in the formation 12. The casing 60 extends for the entire length of that portion of the wellbore in which the workstring 16 and the subs 20 and 26 extend. Thus, the casing 60, as well as the axes of the subs 20 and 26 extend substantially vertically.

Prior to the introduction of the stimulation fluid into the jet sub 20, a liquid, or the stimulation fluid, mixed with sand is introduced into the jet sub 20 and discharges from the openings 22 in the jet sub and against the inner wall of the casing 60 at a very high velocity, as discussed above, causing tiny openings, or perforations, to be formed through the latter wall. A much larger amount of "perforating" fluid is used than the amount used in conjunction with embodiments 1–3 above; as it is much harder for the fluid to penetrate the casing walls. Then the operation described in connection with the embodiments of FIGS. 1–3 above, is initiated and the mixture of stimulation fluid and foamed gas discharge, at a relatively high velocity, through the openings 22, through the above openings in the casing 60, and against the formation 12 to fracture it in the manner discussed above. Otherwise the operation of the embodiment of FIG. 5 is identical to those of FIGS. 1–4.

Figure 6:
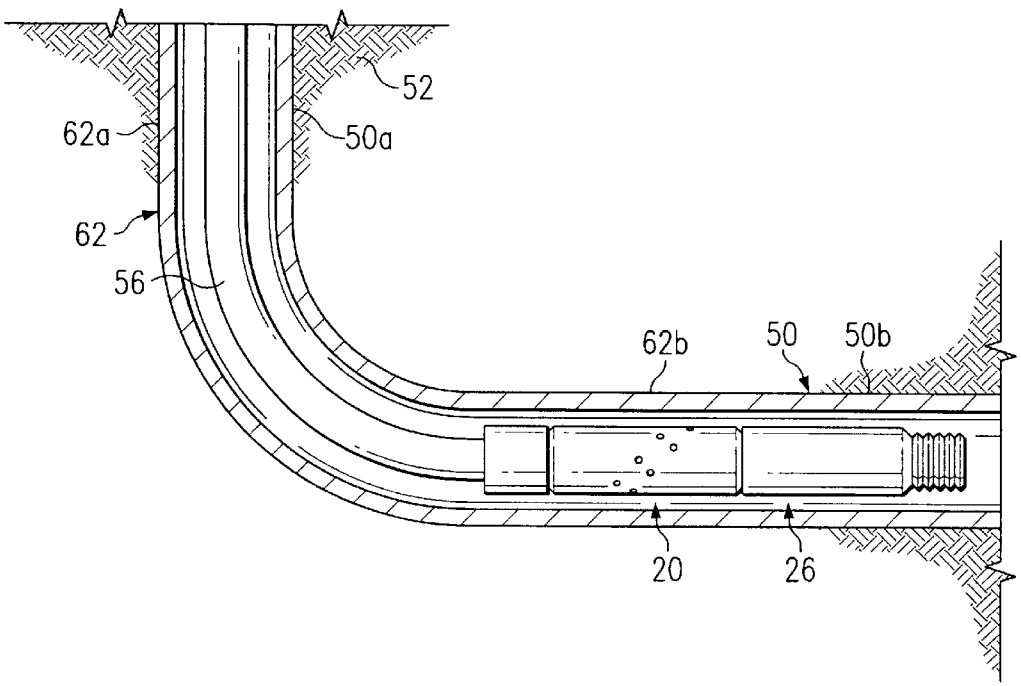
FIG. 6 is a view similar to that of FIG. 5, but depicting the fracturing system of the embodiment of FIG. 5 in a wellbore having a horizontal deviation.

The embodiment of FIG. 6 is similar to that of FIG. 4 and utilizes many of the same components of the latter embodiments, which components are given the same reference numerals. In the embodiment of FIG. 6, a casing 62 is provided which extends from the ground surface (not shown) into the wellbore 50 formed in the formation 52. The casing 62 extends for the entire length of that portion of the wellbore in which the workstring 56 and the subs 20 and 22 are located. Thus, the casing 62 has a substantially vertical section 62*a* and a substantially horizontal section 60*b* that extend in the wellbore sections 50*a* and 50*b*, respectively. The subs 20 and 26 are located in the casing section 62*b* and their respective axes extend substantially horizontally.

Prior to the introduction of the stimulation fluid into the jet sub 20, a liquid mixed with sand is introduced into the work string 16 with the ball valve 46 (FIG. 3) in place. The liquid/sand mixture discharges from the openings 22 (FIG. 2) in the jet sub 20 and against the inner wall of the casing 62 at a very high velocity, causing tiny openings to be formed through the latter wall. Then the stimulation operation described in connection with the embodiments of FIGS. 1–3, above, is initiated with the mixture of stimulation fluid and foamed gas discharging, at a relatively high velocity, through the openings 22, through the above openings in the casing 62, and against the formation 52 to fracture it in the manner discussed above. Otherwise the operation of the embodiment of FIG. 6 is identical to those of FIGS. 1–3.

Each of the above embodiments thus combines the features of fracturing with the features of foam generation and use, resulting in several advantages all of which enhance the stimulation of the formation and the production of hydrocarbons. For example, the foam reduces the fluid loss or leakoff of the stimulation fluid and thus increases the fracture length so that better stimulation results are obtained. Also, elaborate and expensive packers to establish the high pressures discussed above are not needed. Moreover, after all of the above-described stimulation stages are completed, the foam helps the removal of the spent stimulation fluid from the wellbore which, otherwise, is time consuming. Further, the stimulation fluid is delivered in substantially a liquid form thus reducing friction and operating costs. The embodiments of FIGS. 5 and 6 enjoy all of the above advantages in addition to permitting spotting of the stimulation fluid in more specific locations through the relatively long casing.

EQUIVALENTS AND ALTERNATIVES

It is understood that variations may be made in the foregoing without departing from the scope of the invention.

For example, the gas can be pumped into the annulus after the perforating stage discussed above and the stimulation fluid, sans the proppants, can be discharged into the annulus as described above to mix with the gas. Also the gas flowing in the annulus 28 can be premixed with some liquids prior to entering the casing 14 for many reasons such as cost reduction and increasing hydrostatic pressure. Moreover, the makeup of the stimulation fluid can be varied within the scope of the invention. Further, the particular orientation of the wellbores can vary from completely vertical to completely horizontal. Still further, the particular angle that the discharge openings extend relative to the axis of the jet sub can vary. Moreover, the openings 22 in the sub 20 could be replaced by separately installed jet nozzles that are made of exotic materials such as carbide mixtures for increased durability. Also, a variety of other fluids can be used in the annulus 28, including clean stimulation fluids, liquids that chemically control clay stability, and plain, low-cost fluids.

Although only a few exemplary embodiments of this invention have been described in detail above, those skilled in the art will readily appreciate that many other modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures.

What is claimed is:

1. A method of fracturing a downhole formation comprising locating a plurality of jet nozzles in a spaced relation to the wall of the formation to form an annulus between the nozzles and the formation; pumping a non-acid containing stimulation fluid at a predetermined pressure through the nozzles, into the annulus and against the wall of the formation; and pumping a gas into the annulus so that the stimulation fluid mixes with the gas to generate foam before the mixture is jetted towards the formation to form fractures in the formation.

2. The method of claim 1 wherein the fluid has a pH level above 5.

3. The method of claim 2 wherein the stimulation fluid is a linear or crosslinked gel.

4. The method of claim 3 further comprising adding proppants to the mixture.

5. The method of claim 3 wherein the foam in the mixture reduces the fluid loss into the fracture faces; hence increasing extension of the fracture into the formation.

6. The method of claim 4 further comprising reducing the fluid pressure in the annulus to terminate the fracture extension.

7. The method of claim 1 wherein a wellbore is formed in the formation and has a vertical component and a horizontal component.

8. The method of claim 7 wherein the step of locating the jet nozzles comprises attaching the jet nozzles to a work string and inserting the work string in the wellbore.

9. The method of claim 8 further comprising inserting a casing in the formation and pumping a liquid/sand mixture through the jet nozzles so as to perforate the casing prior to the steps of pumping.

10. A method of fracturing a downhole formation comprising locating a plurality of jet nozzles in a work string disposed in a spaced relation to the wall of the formation to form an annulus between the nozzles and the formation; adding proppants to a non-acid containing stimulation fluid, pumping the proppants-laden fluid at a predetermined pressure through the nozzles, into the annulus and against the wall of the formation; and pumping a gas into the annulus so that the proppants-laden fluid mixes with the gas to generate foam which is jetted towards the formation to form fractures in the formation.

11. The method of claim 10 further comprising terminating the step of adding proppants, and controlling the pressure of the mixture of fluid and gas so that it is less than, or equal to, the fracturing pressure.

12. The method of claim 11 further comprising then adding relatively coarse proppants to the mixture of fluid and gas to increase the size of the fracture.

13. The method of claim 12 further comprising flushing the proppants from the workstring.

14. The method of claim 13 further comprising packing the fracture with proppants before the flushing is completed.

15. The method of claim 13 wherein the step of packing comprises reducing the pressure of the mixture in the annulus while the proppant-laden fluid is forced into the fracture.

16. The method of claim 15 wherein the pressure of the mixture in the annulus is reduced to a level higher that the pressure in the pores in the formation and below the fracturing pressure.

17. Apparatus for stimulating a downhole formation, the apparatus comprising a plurality of jet nozzles disposed in a spaced relation to the wall of the formation to form an annulus between the nozzles and the formation, means for introducing an acid-containing, stimulation fluid at a predetermined pressure through the nozzles into the annulus and against the wall of the formation, and means for introducing a gas into the annulus so that the stimulation fluid mixes with the gas to generate foam before the mixture is jetted towards the formation to impact the formation wall.

18. The apparatus of claim 17 wherein the nozzles direct the fluid in a substantially radial direction towards the formation wall.

19. The apparatus of claim 17 wherein the mixture causes a fracture in the formation wall, and further comprising means for reducing the pressure of the mixture and the gas pressure in the annulus when the space between the fracture is filled with fluid.

20. The apparatus of claim 19 further comprising means for further reducing the pressure of the mixture and the gas pressure in the annulus to allow closure of the fracture.

* * * * *